US011131126B2

(12) United States Patent
Ehrlich et al.

(10) Patent No.: US 11,131,126 B2
(45) Date of Patent: Sep. 28, 2021

(54) DOORHANDLE ASSEMBLY WITH A VEHICLE DOORHANDLE

(71) Applicant: Continental Automotive GmbH, Hannover (DE)

(72) Inventors: Stefan Ehrlich, Vienna (AT); Andreas Egger, Groß-Enzersdorf (AT)

(73) Assignee: Continental Automotive GmbH

( * ) Notice: Subject to any disclaimer, the term of this patent is extended or adjusted under 35 U.S.C. 154(b) by 632 days.

(21) Appl. No.: 16/076,840

(22) PCT Filed: Sep. 5, 2017

(86) PCT No.: PCT/EP2017/072247

§ 371 (c)(1),
(2) Date: Aug. 9, 2018

(87) PCT Pub. No.: WO2018/050493

PCT Pub. Date: Mar. 22, 2018

(65) Prior Publication Data

US 2019/0048623 A1 Feb. 14, 2019

(30) Foreign Application Priority Data

Sep. 16, 2016 (DE) ..... 10 2016 217 797.4

(51) Int. Cl.
*E05B 81/16* (2014.01)
*E05B 81/06* (2014.01)
(Continued)

(52) U.S. Cl.
CPC ..... *E05B 81/16* (2013.01); *E05B 81/06* (2013.01); *E05B 81/30* (2013.01); *E05B 81/62* (2013.01);
(Continued)

(58) Field of Classification Search
CPC ..... E05B 81/06; E05B 81/16; E05B 81/30; E05B 81/56; E05B 81/62; E05B 81/76;
(Continued)

(56) References Cited

U.S. PATENT DOCUMENTS 5,844,470 A 12/1998 Garnault et al.
8,443,553 B1 5/2013 Polewarczyk et al.
(Continued)

FOREIGN PATENT DOCUMENTS

CN 2806668 Y 8/2006
CN 105093977 A 11/2015
(Continued)

OTHER PUBLICATIONS

German Search Report for German Application No. 10 2016 217 797.4, dated Jul. 13, 2017, with partial translation—6 pages.
(Continued)

*Primary Examiner* — Kristina R Fulton
*Assistant Examiner* — Christopher F Callahan
(74) *Attorney, Agent, or Firm* — RatnerPrestia

(57) ABSTRACT

A door handle assembly having a vehicle door handle and a vehicle door. The vehicle door handle moves between a first, retracted position, in which an essentially planar surface of the vehicle door handle is flush with an outer face of the vehicle door, and a second, extended position, in which a grip opening between the outer face of the vehicle door and a grip inner side of the vehicle door handle is cleared for a user. The vehicle door handle is movable between the first and second positions aided by an electric motor, controlled by a control unit. The electric motor can be set in rotation starting from the second position of the door handle by application of a user's external force on the basis of a
(Continued)

mechanical coupling of the vehicle door handle to the electric motor sensed by a sensing unit and fed to the control unit.

16 Claims, 2 Drawing Sheets

(51) Int. Cl.
*E05B 85/10* (2014.01)
*E05B 81/76* (2014.01)
*E05B 81/62* (2014.01)
*E05B 81/30* (2014.01)
*E05B 85/14* (2014.01)

(52) U.S. Cl.
CPC ..... *E05B 81/76* (2013.01); *E05B 85/10* (2013.01); *E05B 85/103* (2013.01); *E05B 85/107* (2013.01); *E05B 85/14* (2013.01)

(58) Field of Classification Search
CPC ..... E05B 85/10; E05B 85/14; E05B 85/103; E05B 85/107; Y10S 292/31
See application file for complete search history.

(56) References Cited

U.S. PATENT DOCUMENTS

| | | | | |
|---|---|---|---|---|
| 8,701,353 | B2 * | 4/2014 | Patel | E05B 85/103 49/503 |
| 8,786,401 | B2 | 7/2014 | Sobecki et al. | |
| 9,062,478 | B2 | 6/2015 | Bingle et al. | |
| 9,103,143 | B2 | 8/2015 | Wheeler et al. | |
| 9,151,089 | B2 | 10/2015 | Aerts et al. | |
| 9,650,815 | B2 | 5/2017 | Conner et al. | |
| 2009/0039671 | A1 | 2/2009 | Thomas et al. | |
| 2011/0148575 | A1 | 6/2011 | Sobecki et al. | |
| 2013/0079984 | A1 | 3/2013 | Aerts et al. | |
| 2014/0132012 | A1 * | 5/2014 | Yoshino | E05B 85/103 292/336.3 |
| 2015/0233154 | A1 * | 8/2015 | Smart | E05B 81/90 70/237 |
| 2015/0315826 | A1 * | 11/2015 | Lang | E05B 85/103 49/503 |
| 2016/0273247 | A1 * | 9/2016 | Fujiwara | E05B 81/36 |
| 2016/0298366 | A1 * | 10/2016 | Och | E05B 85/103 |

FOREIGN PATENT DOCUMENTS

| | | | | |
|---|---|---|---|---|
| CN | 105464492 | A | 4/2016 | |
| DE | 19634542 | A1 | 3/1997 | |
| DE | 102012010456 | A1 | 11/2013 | |
| DE | 102015011468 | A1 | 3/2017 | |
| WO | WO-2016151131 | A1 * | 9/2016 | B60J 5/0415 |
| WO | WO-2017198920 | A1 * | 11/2017 | E05B 85/103 |

OTHER PUBLICATIONS

International Search Report and Written Opinion for International Application No. PCT/EP2017/072247, dated Oct. 20, 2017—8 pages.
Chinese Office Action for Chinese Application No. 201780016465.8, dated Jul. 24, 2019, with translation, 14 pages.

* cited by examiner

DOORHANDLE ASSEMBLY WITH A VEHICLE DOORHANDLE

CROSS REFERENCE TO RELATED APPLICATIONS

This application is the U.S. National Phase Application of PCT International Application No. PCT/EP2017/072247, filed Sep. 5, 2017, which claims priority to German Patent Application No. 10 2016 217 797.4, filed Sep. 16, 2016, the contents of such applications being incorporated by reference herein.

FIELD OF THE INVENTION

The invention relates to a door handle assembly having a vehicle door handle and a vehicle door, wherein the vehicle door handle can be moved between a first, retracted position, in which an essentially planar surface of the vehicle door handle is flush with an outer face of the vehicle door, and a second, extended position, in which a grip opening between the outer face of the vehicle door and a grip inner side of the vehicle door handle is cleared for a user. The vehicle door handle can be moved between the first position and the second position with the aid of an electric motor, which can be controlled by a control unit.

BACKGROUND OF THE INVENTION

Such a vehicle door handle assembly is known for example from U.S. Pat. No. 9,151,089 B2, incorporated herein by reference. If the vehicle door handle which is described therein is not required, it is retracted into the interior of the vehicle door, so that its essentially planar surface is flush with the outer face of the vehicle door. If a user presses on the vehicle door handle, the pressure which is caused thereby is sensed by a pressure sensor, so that the vehicle door handle is moved into its extended position by the electric motor. If a hand of a user pulls on the extended vehicle door handle, the force which is produced thereby is sensed by a force sensor, and as a result unlocking of a door lock is brought about by the control unit. The two sensors are also used to stop the drive of the motor if the vehicle door handle moves between the retracted position and the extended position, as well as vice versa, in order to detect the respective end position. The use of the sensors in such a door handle assembly makes it possible to eliminate capacitive or inductive sensors or pushbutton keys or switches in or on the door handle for sensing the presence of a hand on or in the door handle and as a result unlocking or locking the vehicle door when authorization is given.

SUMMARY OF THE INVENTION

An aspect of the invention aims to provide a door handle assembly which advantageously develops the arrangement described at the beginning in terms of design and/or function.

Taking as a basis a door handle assembly as described above having a vehicle door handle and a vehicle door, wherein the vehicle door handle can be moved between a first, retracted position, in which an essentially planar surface of the vehicle door handle is flush with an outer face of the vehicle door, and a second, extended position, in which a grip opening between the outer face of the vehicle door and a grip inner side of the vehicle door handle is cleared for a user with the aid of an electric motor, an aspect of the invention proposes that the electric motor can be set in rotation starting from the second position of the vehicle door handle by the application of an external force by a user on the vehicle door handle on the basis of a mechanical coupling of the vehicle door handle to the electric motor, which rotation can be sensed by a sensing unit and fed to the control unit for evaluation.

The door handle assembly according to an aspect of the invention makes use of the fact that mechanical activation of the vehicle door handle, during which the vehicle door handle is moved in the direction of the vehicle door or counter to the direction of the vehicle door by a user, also sets the electric motor in rotation. This rotation can be detected by a sensing unit. Such rotation is interpreted as activation of the vehicle door handle, as a result of which locking or unlocking of the vehicle door is made possible with the aid of the control unit. However, it is, in particular, possible to completely eliminate the force sensors and pressure sensors present in the prior art, so that the door handle assembly according to an aspect of the invention has a less complex design. As a result, such a door handle assembly can be made available at lower costs.

According to one expedient refinement, the external force is a force which is directed in the direction of the vehicle door or a force which points away from the vehicle door, wherein the direction of the external force acting on the vehicle door handle can be detected by evaluating the rotational direction of the electric motor. On the basis of the rotational direction of the electric motor it is therefore possible to detect whether the vehicle door is intended to be locked or unlocked.

A further expedient refinement provides that after the detection of an external force directed in the direction of the vehicle door the control unit actuates the electric motor in order to move the vehicle door handle into the first position. In other words, this means that after the vehicle door handle has been pressed emanating from the second, extended position, a certain amount in the direction of the vehicle door by the application of an mechanical force by a user, and therefore a locking request has been detected by the control unit, the electric motor is actuated by the control unit in order finally to retract the vehicle door handle completely into the vehicle door and therefore move into the first position. This means a gain in comfort for the user, since the user does not need to move the extended vehicle door handle into the first, retracted position entirely by applying a mechanical force.

The electric motor is expediently controlled by the control unit in such a way that the external force, directed in the direction of the vehicle door, by the user between the second and the first position is compensated by an opposing force applied by the electric motor in accordance with a predefined force/travel characteristic curve. The opposing force applied by the electric motor is expediently smaller than the external (compressive) force applied by the user. As a result, specific haptics of the vehicle door handle, such as they are known, for example, from conventional vehicle door handles which are held in position by springs, can be simulated.

Another refinement provides that the vehicle door handle can be moved, by the application of the external force, pointing away from the vehicle door, by the user, from the second position into a third, pulled-out position in which the grip opening between the outer face of the vehicle door and a grip inner side of the vehicle door handle can be enlarged in comparison with the second position. As a result a conventional behavior of a bow handle is simulated. In order to open the vehicle door and, if appropriate, to unlock a lock of the vehicle door, a user grips the bow handle with his hand and pulls it (with simultaneous enlargement of the grip opening) up to a mechanical end stop toward the outside, in order to unlock the lock and at the same time to open the door by the application of the user's force. The door assembly according to an aspect of the invention therefore has, in addition to the first, retracted position and the second, extended position, a third position with which the behavior which is known from conventional bow handles is simulated.

It is expedient if the external force (i.e. a pulling force), pointing away from the vehicle door, of the user is transmitted directly from the vehicle door handle to the vehicle door starting from when the third position is reached by a mechanical stop. As a result, the behavior which is known from conventional bow handles, in which the bow handle has a mechanical end stop which transmits a force, transmitted to the bow handle, to the vehicle door for the purpose of opening, is also simulated.

It is also expedient if the electric motor is controlled by the control unit in such a way that the external force, pointing away from the vehicle door, by the user, is compensated, between the second and the third position, by an opposing force applied by the electric motor, in accordance with a predefined force/travel characteristic curve. The opposing force is expediently lower than the external force which is applied by the user and which is a pulling force here. As a result, the haptics of a known door handle which is held in position by springs can be easily simulated.

According to a further expedient refinement, the control unit evaluates an induced voltage which is generated by a rotation, brought about by the external force, of the electric motor and infers the rotational angle of the electric motor which is brought about by the external force. As a result, it is easily possible to detect the application of the external force and of the movement caused thereby in the direction of the first position (for locking the vehicle door) or the direction pointing away from the vehicle door (for unlocking and opening the vehicle door) and to generate a corresponding command for a door lock. It is therefore possible, without the presence of an additional sensor, to detect, on the one hand, the presence of a user's hand and the action performed by the user. A door handle assembly which is constructed in such a way can be made available with a minimum number of components as possible in an easy and cost-effective way.

In an alternative refinement, a sensor, in particular a Hall sensor, is provided for detecting the rotation of the electric motor which detects the number of the rotational angle, brought about by the external force, of the electric motor. With the aid of a sensor it is possible to determine the position of the electric motor with respect to the brought about revolutions of the motor precisely. In this way it is possible, on the basis of the more precise determination of the position of the motor, to implement easily a force/travel characteristic curve for simulating desired haptics when the vehicle door handle is activated.

A further refinement provides that when a first predefined rotational angle is exceeded, the control unit outputs a signal for unlocking a door lock if the evaluation of the rotational direction reveals that the external force points away from the vehicle door.

The control unit can also be designed in such a way that, when a second predefined rotational angle is exceeded, a signal for locking a door lock is output if the evaluation of the rotational direction reveals that the external force is directed in the direction of the vehicle door.

It is also expedient if the control unit carries out the locking or unlocking of the vehicle door and/or the actuation of the electric motor after the checking of authorization. Such checking of the authorization can be carried out, for example, by communication between a key or another identification token which the user of the vehicle carries on his person, and the control unit or another control unit.

In summary, with the proposed door handle assembly it is possible to implement keyless access control only with the aid of an electric motor which is coupled to the door handle, without further sensors being necessary for the detection of the presence of a hand. Sensors can optionally be provided for detecting a rotation or a rotational angle of the electric motor on the basis of activation of the door handle. Furthermore, with the aid of the door handle assembly according to an aspect of the invention, it is possible to generate desired haptics during the activation of the vehicle door handle in that a programmable force/travel characteristic curve is stored in a control unit of the electric motor. As a result, OEM-specific force requirements can be simulated in order to simulate a customary, mechanical bow door handle.

BRIEF DESCRIPTIONS OF THE DRAWINGS

Aspects of the invention are explained in greater detail below on the basis of an exemplary embodiment in the drawings. In the figures.

Figure 3:
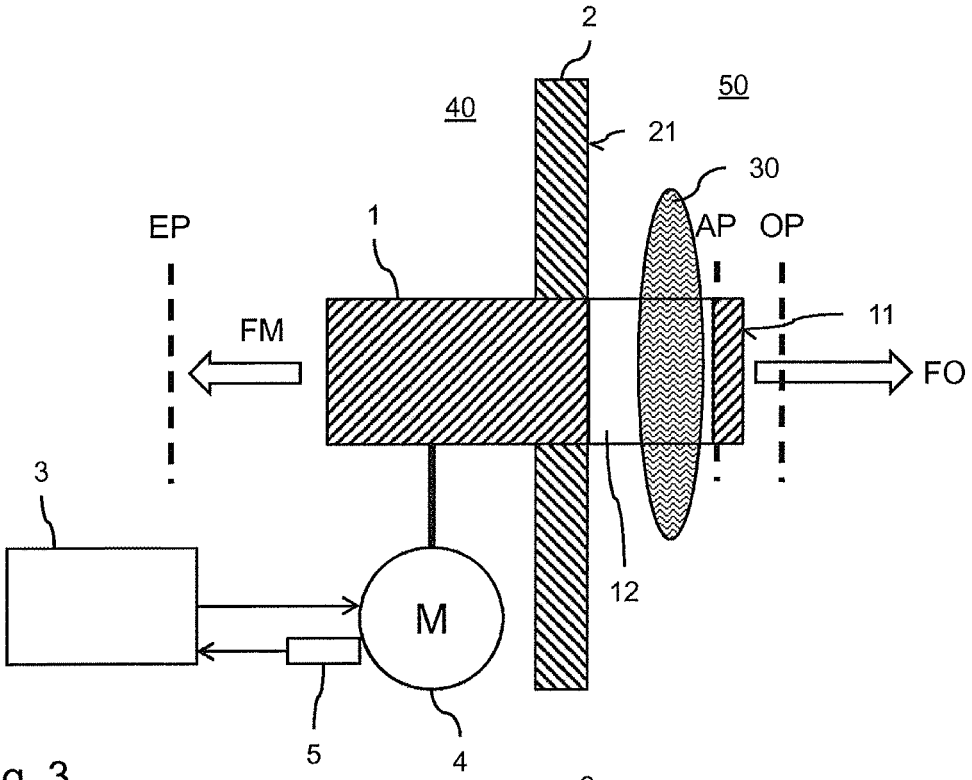
Figure 4:
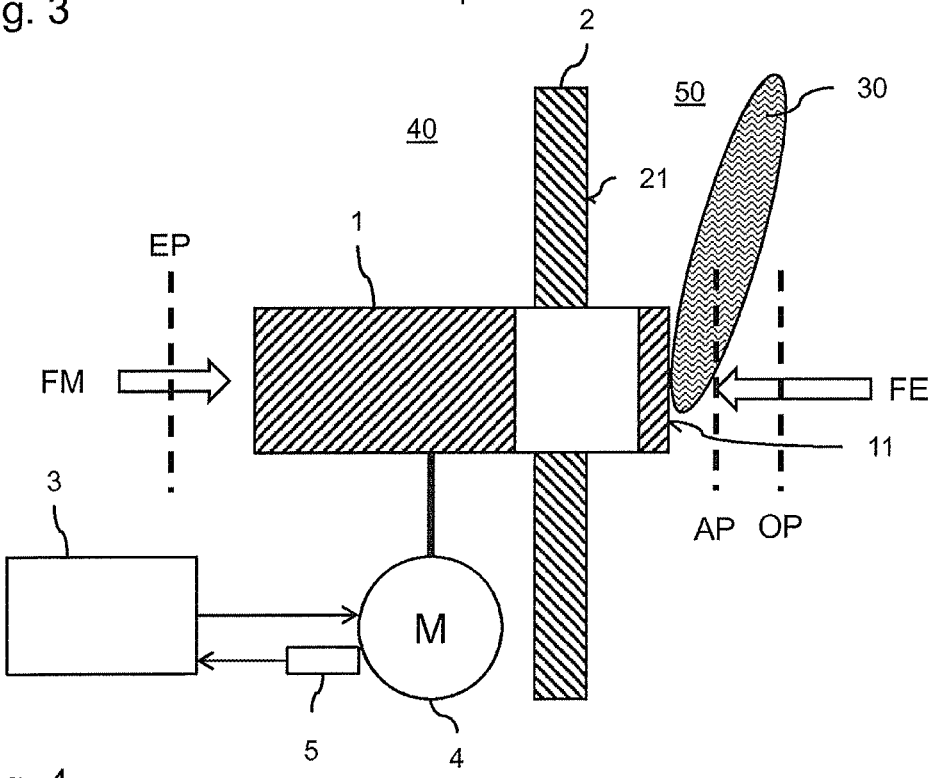

FIG. 3 shows a schematic illustration of the door handle assembly according to an aspect of the invention in which the vehicle door handle is moved from the second, extended position in the direction of a third, pulled-out position by applying an external force, and FIG. 4 shows a schematic illustration of the door handle assembly according to an aspect of the invention in which the vehicle door handle is moved from the second, extended position in the direction of the first, retracted position by applying an external force.

DETAILED DESCRIPTION OF THE PREFERRED EMBODIMENTS

FIGS. 1 to 4 each show a door assembly according to an aspect of the invention in a schematic cross-sectional illustration. The door assembly comprises, as essential components, a vehicle door handle 1 which is illustrated in the side view, and a vehicle door 2, of which a door panel can be seen in the drawings. The internal region of the vehicle door 2 is characterized by the reference number 40 and the external region of the vehicle door 2 by the reference number 50.

A control unit 3 and an electric motor 4 which is mechanically coupled to the vehicle door handle 1 are also provided in the internal region 40 of the vehicle door 2. The electric motor 4 is assigned a sensing unit 5 in the form of a voltage measuring means or a rotational angle sensor which transmit a sensing signal to the control unit 3. The control unit 3 serves to actuate the electric motor 4 in order to drive the vehicle door handle 1 in the way described below.

Figure 1:
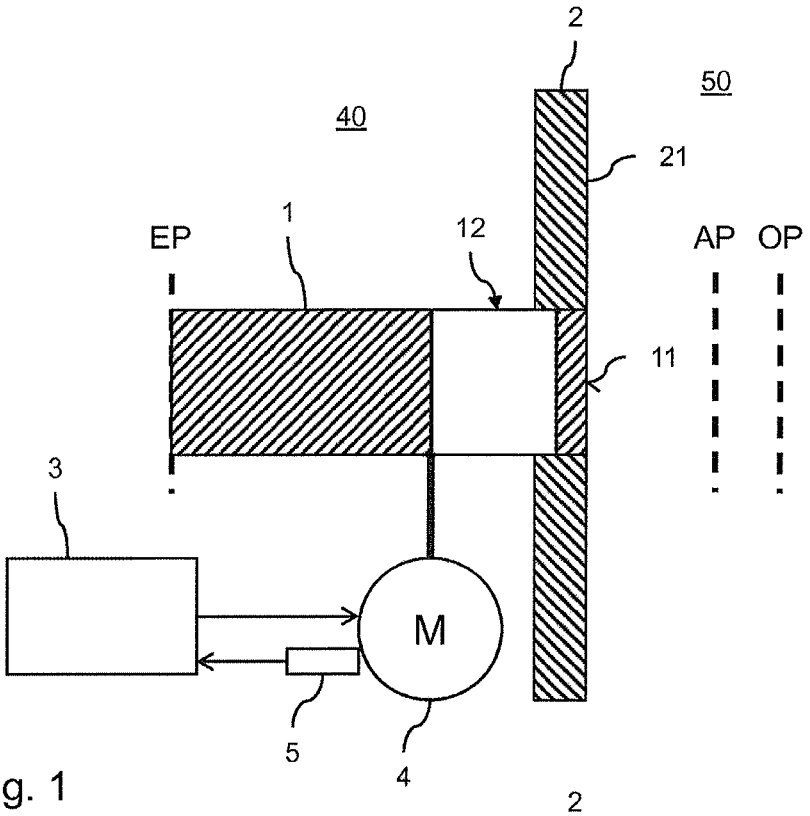
FIG. 1 shows a schematic illustration of a door handle assembly according to an aspect of the invention in which a vehicle door handle is located in its first, retracted position.

The vehicle door handle 1 can be moved between a first, retracted position EP and a second, extended position AP with the aid of the electric motor 4 driven by the control unit 3. FIG. 1 shows the situation in which the vehicle door handle 1 is in the first, retracted position EP, in which an essentially planar surface 11 of the vehicle door handle 1 is flush with an outer face 21 of the vehicle door. In the first, retracted position EP, the vehicle door handle 1 can bear with its end directed into the interior of the vehicle 40 against a mechanical stop (not shown in any more detail).

The vehicle door handle 1 has a grip opening 12 which, when the vehicle door handle 1 is in the first, retracted position EP, is positioned in the internal region 40 of the vehicle door 2, so that the latter is not accessible by a user's hand.

Figure 2:
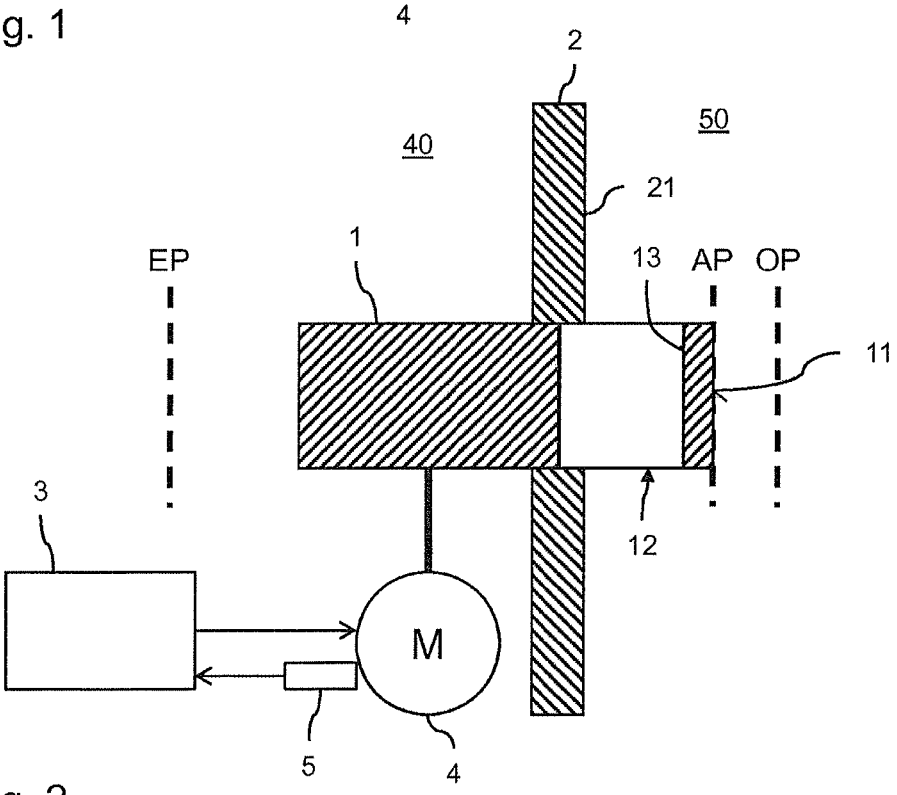
FIG. 2 shows a schematic illustration of the door handle assembly according to an aspect of the invention in which the vehicle door handle is located in its second, extended position.

FIG. 2 shows the vehicle door handle 1 in a second, extended position AP. The movement between the first, retracted position EP and the second, extended position AP takes place as a result of actuation of the electric motor 4 with the aid of the control unit 3. The movement from the first, retracted position EP into the second, extended position AP can then take place, for example, when a user of the vehicle approaches the vehicle with a radio key or another identification means (e.g. token). In the second, extended position AP, the grip opening 12 between the outer face 21 of the vehicle door and a grip inner side 13 of the vehicle door handle is released for a user. A user can put his hand into the grip opening 12 in order to carry out an unlocking or opening in a way known from bow handles.

If the vehicle door handle 2 is in the extended position, the electric motor 4 can thus be actuated by the control unit 3 in such way that this position AP is maintained independently of destructions such as wind, gravity and the like. The compensation forces which are necessary therefor and which are applied by the electric motor are significantly smaller here than an external force which is applied by a user to the vehicle door handle 1 when it is activated.

Taking the second, extended position AP of the vehicle door handle 1 shown in FIG. 2 as a starting point, FIG. 3 shows a situation in which a user's hand or finger 30 engages in the grip opening 12 and pulls the vehicle door handle 1 with an external force FO on the vehicle door handle 1 which points away from the vehicle door handle 2. A rotor of the electric motor 4 is set in rotation on the basis of the mechanical coupling of the vehicle door handle 1 to the electric motor 4. This rotation and the rotational direction are sensed by the sensing unit 5, and an angle which corresponds to the rotation and the rotational direction are transmitted to the control unit for evaluation. If the control unit 3 receives, from the sensing unit 5, a signal that the electric motor 4 is set in rotation by an external force acting on the vehicle door handle 1, the control unit 3 infers a desired opening process of the vehicle door. The direction of the external force (in FIG. 3 the external force FO acts as a pulling force away from the vehicle door 2), can be determined here by detecting the rotational direction of the electric motor 4.

During the application of the external force FO, the electric motor 4 preferably applies, under the control of the control unit 3, an opposing force FM which counteracts the external force FO and is smaller than the external force FO (pulling force of the user) to the vehicle door handle 1. The electric motor 4 is preferably actuated by the control unit 3 in such a way that the external force FO by the user is compensated between the second and a third, pulled-out position OP in accordance with a predefined force/travel characteristic curve. As a result, haptics which are known from conventional spring-loaded bow handles are simulated for the user.

If the vehicle door handle 1 finally reaches the third, pulled-out position OP as a result of the external force FO by the user, a mechanical stop of the vehicle door handle 1 (not shown) is thus reached. This means that from the point when the third, pulled-out position OP is reached, the force FO by the user is transmitted directly from the vehicle door handle 1 to the vehicle door by a mechanical stop in order to open it.

If the vehicle door was firstly locked by a lock, it can furthermore be provided so that a signal for unlocking the door lock is issued during the movement of the vehicle door handle 2 from the second, extended position AP to the third, pulled-up position OP. This signal is preferably output as a function of a predefined rotational angle, detected by the sensing unit 5, of the mechanically rotated electric motor 4.

Finally, after the opening by actuating the electric motor, the vehicle door handle 1 can be returned again to the second position AP, as a result of which a restoring force is simulated. An external force FO by the user can also be compensated here in order to simulate a spring.

FIG. 4 shows a situation in which the vehicle door handle 1 is pressed by a hand or a finger 30 of the user in the direction of the door 2 starting from the second, extended position AP. The user's hand or finger 30 applies for this purpose an external force FE which acts in the direction of the vehicle door handle 2. The direction of the external force FE can be detected by the rotational direction of the electric motor 4 which is set in rotation by the movement of the vehicle door handle, and the associated sensing unit 5. After the detection of the external force FE which is directed in the direction of the vehicle door handle 2, the control unit 3 then actuates the electric motor 4 in order finally to move the vehicle door handle into the first, retracted position EP. It is also in turn expedient here that the control unit 3 actuates the electric motor 4 in such a way that during the application of the external force FE, directed in the direction of the vehicle door 2, by the user an opposing force FM, applied by the electric motor 4, is generated in accordance with a predefined force/travel characteristic curve. The opposing force FM is smaller here than the external pressure force FE which is applied by the user. As a result, predefined haptics can be generated in turn during the condition of the vehicle door handle 1.

Furthermore, when a predefined rotational angle of the electric motor 4 is exceeded, the control unit can output a signal for locking the door lock (not shown) if the evaluation of the rotational direction has revealed that the external force FE is directed in the direction of the vehicle door.

The locking and unlocking of the described door lock can be made dependent on the fact that the control unit was able to positively execute an authorization for opening and closing the motor vehicle.

The sensing unit 5 can be embodied without sensors. In this case, electronics of the sensing unit (or alternatively also a unit which is located in the control unit 3) evaluates the voltage induced by the mechanical rotation of the electric motor 4. As a result of the presence of the voltage it is possible to infer that a movement of the vehicle door handle takes place on the basis of an external force FO or FE. The sign of the voltage can be used to detect the rotational direction of the electric motor 4. Furthermore, on the basis of the level and/or the duration of the sensed induced voltage it is possible to infer a rotational angle of the electric motor in order, on the one hand, to carry out actuation of the door lock and/or to generate an opposing force FM which is suitable for the acting external force.

Furthermore, the sensing unit 5 can also have a sensor. In particular a Hall sensor can be used as the sensor, with the aid of which Hall sensor it is possible to determine the position of the motor as well as a rotational angle. With the aid of one or more sensors it is possible to detect a manual external force and generate a signal for actuating the door lock. Furthermore, the use of a sensor permits a force/travel characteristic curve for generating an opposing force to be generated easily in order to generate desired haptics.

The invention claimed is:

1. A door handle assembly having a vehicle door handle and a vehicle door, wherein the vehicle door handle is moveable between a first, retracted position, in which an essentially planar surface of the vehicle door handle is flush with an outer face of the vehicle door, and a second, extended position, in which a grip opening between the outer face of the vehicle door and a grip inner side of the vehicle door handle is cleared for a user, and wherein the vehicle door handle moves between the first position and the second position with the aid of an electric motor, which is controlled by a control unit, wherein the electric motor is adapted to be set in rotation starting from the second position of the vehicle door handle by application of an external force by a user on a mechanical coupling of the vehicle door handle to the electric motor, which then rotation is sensed by a sensing unit and fed to the control unit for evaluation during the actuation of the door handle assembly.

2. The door handle assembly as claimed in claim 1, wherein the external force is a force which is directed in the direction of the vehicle door or is a force which points away from the vehicle door, and wherein the direction of the external force acting on the vehicle door handle is detected by evaluating the rotational direction of the electric motor.

3. The door handle assembly as claimed in claim 1, wherein after the detection of an external force directed in the direction of the vehicle door the control unit actuates the electric motor in order to move the vehicle door handle into the first position.

4. A door handle assembly having a vehicle door handle and a vehicle door, wherein the vehicle door handle is moveable between a first, retracted position, in which an essentially planar surface of the vehicle door handle is flush with an outer face of the vehicle door, and a second, extended position, in which a grip opening between the outer face of the vehicle door and a grip inner side of the vehicle door handle is cleared for a user, and wherein the vehicle door handle moves between the first position and the second position with the aid of an electric motor, which is controlled by a control unit, wherein the electric motor is adapted to be set in rotation starting from the second position of the vehicle door handle by application of an external force by a user on the basis of a mechanical coupling of the vehicle door handle to the electric motor, which rotation is sensed by a sensing unit and fed to the control unit for evaluation during the actuation of the door handle assembly, wherein after the detection of an external force directed in the direction of the vehicle door the control unit actuates the electric motor in order to move the vehicle door handle into the first position, and wherein the electric motor is controlled by the control unit in such a way that the external force of the user which external force is directed in the direction of the vehicle door between the second and the first position is compensated by an opposing force applied by the electric motor, in accordance with a predefined characteristic curve based on at least one of force or travel.

5. The door handle assembly as claimed in claim 1, wherein the vehicle door handle is moveable, by the application of the external force, pointing away from the vehicle door, by the user, from the second position into a third, pulled-out position in which the grip opening between the outer face of the vehicle door and a grip inner side of the vehicle door handle is enlarged in comparison with the second position.

6. The door handle assembly as claimed in claim 5, wherein the external force, pointing away from the vehicle door, of the user is transmitted directly from the vehicle door handle to the vehicle door starting from when the third position is reached by a mechanical stop.

7. The door handle assembly as claimed in claim 5, wherein the electric motor is controlled by the control unit in such a way that the external force of the user which external force points away from the vehicle door is compensated between the second and the third position, by an opposing force applied by the electric motor, in accordance with a predefined characteristic curve based on at least one of force or travel.

8. A door handle assembly having a vehicle door handle and a vehicle door, wherein the vehicle door handle is moveable between a first, retracted position, in which an essentially planar surface of the vehicle door handle is flush with an outer face of the vehicle door, and a second, extended position, in which a grip opening between the outer face of the vehicle door and a grip inner side of the vehicle door handle is cleared for a user, and wherein the vehicle door handle moves between the first position and the second position with the aid of an electric motor, which is controlled by a control unit, wherein the electric motor is adapted to be set in rotation starting from the second position of the vehicle door handle by application of an external force by a user on the basis of a mechanical coupling of the vehicle door handle to the electric motor, which rotation is sensed by a sensing unit and fed to the control unit for evaluation during the actuation of the door handle assembly, and wherein the control unit evaluates an induced voltage which is generated by a rotation of the electric motor which rotation is brought about by the external force, and said control unit determines the rotational angle of the electric motor which is brought about by the external force.

9. The door handle assembly as claimed in claim 1, wherein a sensor is provided for detecting the rotations of the electric motor, which sensor senses the number of the rotational angle, brought about by the external force, of the electric motor.

10. The door handle assembly as claimed in claim 8, wherein when a first predefined rotational angle is exceeded, the control unit outputs a signal for unlocking a door lock if the evaluation of the rotational direction reveals that the external force points away from the vehicle door.

11. The door handle assembly as claimed in claim 8, wherein when a second predefined rotational angle is exceeded, the control unit outputs a signal for locking a door lock if the evaluation of the rotational direction reveals that the external force points in the direction of the vehicle door.

12. The vehicle door assembly as claimed in claim 1, wherein the control unit carries out the locking or unlocking of the vehicle doors and/or the actuation of the electric motor after the checking of authorization.

13. The door handle assembly as claimed in claim 2, wherein after the detection of an external force directed in the direction of the vehicle door the control unit actuates the electric motor in order to move the vehicle door handle into the first position.

14. The door handle assembly as claimed in claim 6, wherein the electric motor is controlled by the control unit in such a way that the external force of the user which external force points away from the vehicle door is compensated between the second and the third position, by an opposing force applied by the electric motor, in accordance with a predefined characteristic curve based on at least one of force or travel.

15. The door handle assembly as claimed in claim 9, wherein the sensor is a Hall sensor.

16. The door handle assembly as claimed in claim 9, wherein when a first predefined rotational angle is exceeded, the control unit outputs a signal for unlocking a door lock if the evaluation of the rotational direction reveals that the external force points away from the vehicle door.

* * * * *